US008603313B2

(12) United States Patent
Allaway et al.

(10) Patent No.: US 8,603,313 B2
(45) Date of Patent: Dec. 10, 2013

(54) ELECTRODE CONFIGURATIONS FOR COATING INTERIOR AND EXTERIOR SURFACES OF CONDUCTIVE SUBSTRATES IN AN ELECTRODEPOSITION COATING PROCESS

(75) Inventors: Michael J. Allaway, Pittsburgh, PA (US); Michael J. Pawlik, Glenshaw, PA (US); James E. Poole, Gibsonia, PA (US); Edward E. Abbott, Canandaigua, NY (US)

(73) Assignee: PPG Industries Ohio, Inc., Cleveland, OH (US)

( * ) Notice: Subject to any disclaimer, the term of this patent is extended or adjusted under 35 U.S.C. 154(b) by 155 days.

(21) Appl. No.: 13/198,801

(22) Filed: Aug. 5, 2011

(65) Prior Publication Data

US 2013/0032482 A1 Feb. 7, 2013

(51) Int. Cl.
*C25D 13/14* (2006.01)

(52) U.S. Cl.
USPC ..... 204/479; 204/625

(58) Field of Classification Search
USPC ..... 204/479, 625, 288, 289
See application file for complete search history.

(56) References Cited

U.S. PATENT DOCUMENTS 4,163,703 A * 8/1979 Gernez ..... 204/479
4,612,107 A * 9/1986 Schlinsog et al. ..... 204/625

* cited by examiner

*Primary Examiner* — Kishor Mayekar
(74) *Attorney, Agent, or Firm* — Alicia M. Passerin

(57) ABSTRACT

An electrode assembly for use in electrophoretically depositing an electrodepositable coating composition onto a conductive substrate having a hollowed interior region therewithin includes a first counter electrode and an electrode assembly comprising a second counter electrode and a deployable primary electrode which are introduced within the hollowed out interior region during the electrodeposition process to provide a deposited electrodeposition coating on inner and outer surfaces.

20 Claims, 7 Drawing Sheets

ELECTRODE CONFIGURATIONS FOR COATING INTERIOR AND EXTERIOR SURFACES OF CONDUCTIVE SUBSTRATES IN AN ELECTRODEPOSITION COATING PROCESS

STATEMENT REGARDING FEDERALLY SPONSORED RESEARCH

This invention was made with Government support under Contract No. W15QKN-07-C-0048 awarded by the Armament Research Development and Engineering Center (ARDEC). The United States Government may have certain rights in this invention.

FIELD OF THE INVENTION

The present invention relates to electrode configurations useful for coating interior and exterior surfaces of conductive substrates in an electrodeposition coating process.

BACKGROUND OF THE INVENTION

The fundamental physical principle of electrocoat is that materials with opposite electrical charges attract each other. An electrocoat system applies a DC charge to a conductive substrate immersed in a bath of oppositely charged paint particles. In theory, the paint particles are drawn to the conductive substrate and paint is deposited on the conductive substrate, forming an even, continuous film over every surface, in every crevice and corner, until the electrocoat reaches the desired thickness. At that thickness, the film insulates the conductive substrate, so attraction stops and the electrocoat process is complete. The desired thickness can be controlled by manipulating the temperature of the bath, the amount of voltage applied, and/or by the coating deposition time. Depending on the polarity of the charge, electrocoat is classified as either anodic or cathodic.

While the theory of electrocoat suggests that each and every surface of a conductive substrate immersed in the bath reaches the same film thickness, this is not always the case. In fact, it is ordinarily very difficult to electrocoat recessed areas of conductive substrates, especially interior regions of hollowed out conductive substrates.

For example, it is very difficult to coat the internal surfaces of hand grenade bodies. Grenade bodies have a nearly spherical shape with only a small hole to access its internal surfaces. Thus, these interior surfaces typically have limited internal paint coverage due to their part geometry.

It would thus be highly desirable to provide a mechanism to attain greater internal paint coverage for grenade bodies. This in turn can be translated to other conductive substrates having similarly difficult to paint internal geometries.

Another related issue with electrocoated films in general relates to the issue of electrode contact points on the surface of the coated conductive substrate and their effect on film quality and corrosion protection. Generally speaking, the coated films in the areas of the contact points may have varying film thicknesses, and thus may be more prone to corrosion and/or provide an unpleasing appearance.

Thus, it would be highly desirable to locate these electrode contact points in recessed or hidden areas that are less likely to be exposed to the environment and to provide a pleasing outer appearance. In the context of a hand grenade, such an area would be along an internal surface that is not exposed to the environment during subsequent use.

SUMMARY OF THE INVENTION

The present invention discloses an electrode assembly comprising: (a) a current source; (b) a first counter electrode, and (c) an electrode assembly comprising (1) a second counter electrode and (2) a deployable primary electrode insulatingly coupled to the second counter electrode and movable between a non-deployed position and a deployed position, the deployable primary electrode comprising a first contact portion and a second contact portion; wherein the first contact portion and the second contact portion are separated by a first distance in the non-deployed position and wherein the first contact portion and the second contact portion are separated by a second distance in the deployed position, the first distance is different than the second distance.

An associated method for applying an electrodeposited coating to the outer surface and inner surface of the conductive substrate using the electrode assembly is also provided.

DETAILED DESCRIPTION

Figure 1:
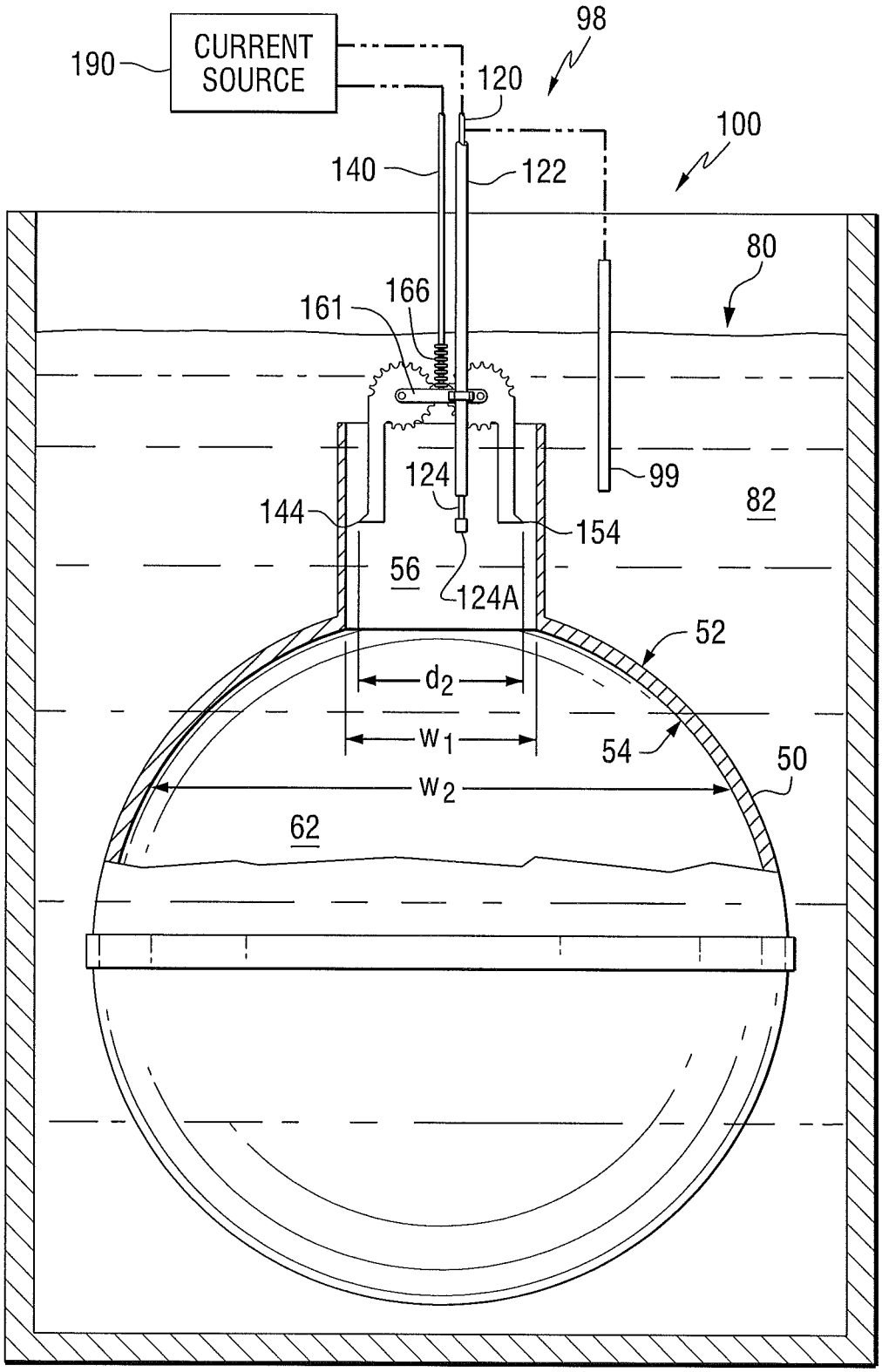
FIG. 1 is a view of an electrode assembly for an electrodeposition system including an electrode assembly in a non-deployed position prior to insertion within a conductive substrate according to one embodiment of the present invention.

For purposes of the following detailed description, it is to be understood that the invention may assume various alternative variations and step sequences, except where expressly specified to the contrary. Moreover, other than in any operating examples, or where otherwise indicated, all numbers expressing, for example, quantities of ingredients used in the specification and claims are to be understood as being modified in all instances by the term "about". Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances.

As noted above, the present invention discloses an electrode assembly that is used for coating inner and outer surfaces of conductive substrates in an electrodeposition coating line. Notably, the present invention provides an electrode assembly, and associated method of use, that may be utilized to coat conductive substrates having inner surface that are relatively difficult to coat due to their part geometry. For example, the present invention finds use in coating metal parts having a hollowed out interior region. One exemplary part that may be coated is a hand grenade, which is generally spherical in shape and includes a small hole to access its interior surfaces.

The electrode assembly, in certain embodiments and as discussed in more detail below with respect to the more specific exemplary embodiments, includes a first counter electrode (in some cases referred to as an external counter electrode) and an electrode assembly comprising a second counter electrode (in some cases also known as a internal counter electrode) and a primary electrode, in which the primary electrode is a deployable electrode ("a deployable primary electrode") that has at least a pair of contact portions. The electrode assembly is inserted with the hollowed out interior region of the conductive substrate in a non-deployed position (also known as an insertion position), wherein the deployable primary electrode is deployed (i.e. moved from a non-deployed position to a deployed position—otherwise known as an operational position) and the respective contact portions are placed into contact (i.e. electrical contact) with the inner surface of the conductive substrate. The conductive substrate is submerged in an electrodeposition bath that includes an electrodepositable coating composition. The bath includes colloidal particles suspended in a liquid medium. The colloidal particles migrate under the influence of an electric field (electrophoresis) and are deposited onto the inner and outer surfaces of the conductive substrate to a desired thickness. The desired thickness of the deposited coating onto the inner surface and the outer surface of the conductive substrate can be controlled by manipulating the temperature of the electrodeposition bath, the amount of voltage applied from a current source, and/or by the coating deposition time.

The present invention may be utilized in conventional cationic or anionic electrodeposition systems. In anodic deposition systems, the first counter electrode and the second counter electrode are electrically coupled together and are the cathode, and the conductive substrate (here, the deployable internal electrode) is an anode, and the electrodepositable coating composition will have negatively charged anions that react with the positively charged hydrogen ions (protons) which are being produced at the anode. Conversely, in a cationic deposition process, the first counter electrode and the second counter electrode are electrically coupled together and are the anode (and the deployable internal electrode is the cathode), and the electrodeposition bath to be deposited will have salts of a base as the charge bearing group. The composition of the electrodeposition bath is conventional in nature and does not form a part of the inventive aspect of the present invention as described herein.

The present invention may also be used to coat the inner and outer surfaces of conductive substrates having on various internal hollowed out configurations. In general, as will be utilized in each the embodiments described below for the present invention, the conductive substrate 50 includes an outer surface 52 and an inner surface 54. The inner surface 54 is accessible through an internal opening 56 having a width w1. The inner surface 54 defines a hollowed out region, or interior 62, having at least one width w2 that is greater than the internal opening width w1 of the opening 56. The conductive substrate 50 may be made of any variety of conductive materials, and may have other shapes and wall thicknesses as shown in the drawings described herein, and is thus not meant to be limited as illustrated in the accompanying figures.

Figure 2:
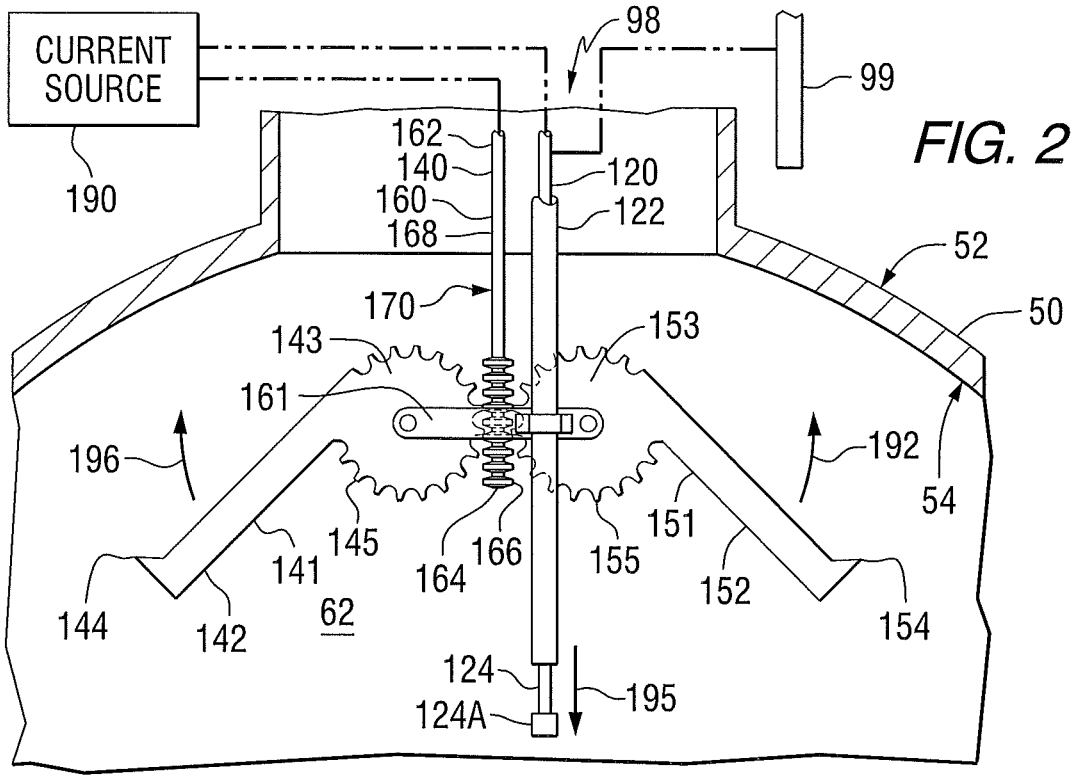
FIG. 2 is a view of an electrode assembly of FIG. 1 having an electrode assembly in a partially-deployed position after insertion into the conductive substrate.
Figure 3:
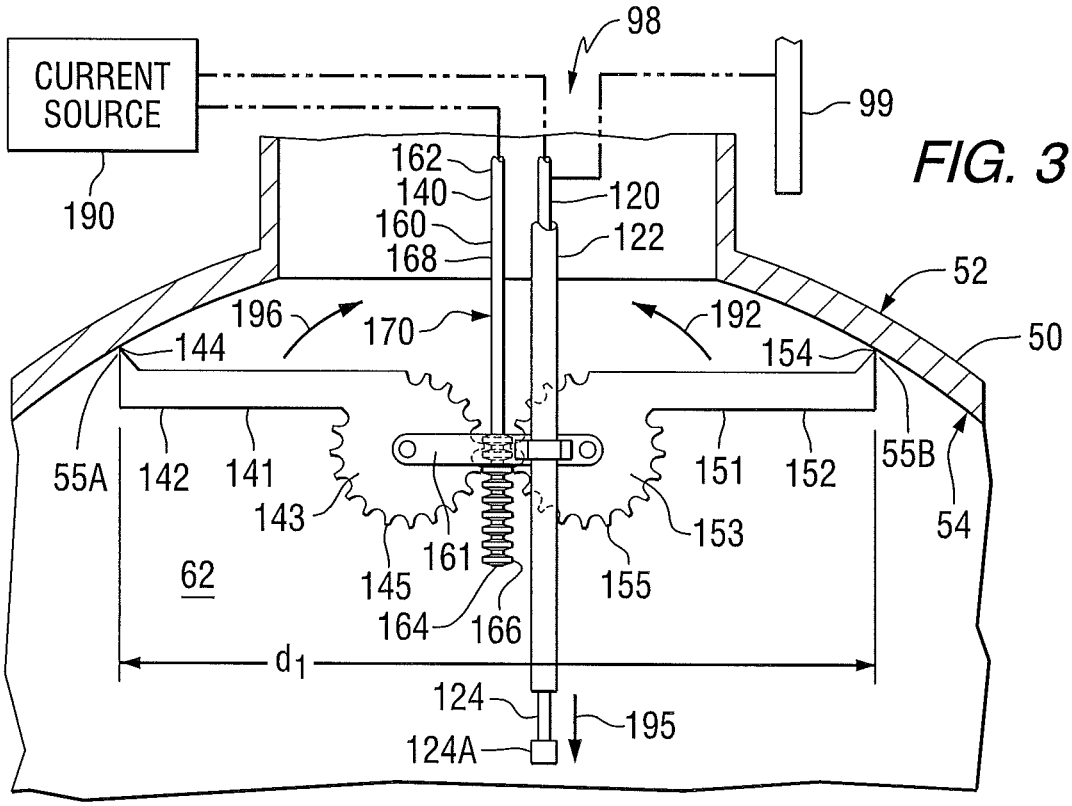
FIG. 3 is a perspective view of an electrode assembly of FIGS. 1 and 2 having an electrode assembly in a deployed position.

In one exemplary embodiment, as shown in FIGS. 1-3, the electrode assembly 98 comprises a first counter electrode 99 and a geared insertion electrode assembly 100 having a second counter electrode 120, and a deployable primary electrode 140 that are insulatingly coupled together with an insulator 161. The second counter electrode 120 is electrically coupled to the first counter electrode 99. The deployable primary electrode 140 and the second counter electrode 120 and/or the first counter electrode 99 are electrically coupled to a direct current source 190. As shown in FIGS. 1-3, the deployable primary electrode 140 and the second counter electrode 120 are electrically coupled to the current source 190, while the first counter electrode 99 is electrically coupled to the second counter electrode 120 to complete the electrical circuit.

The first counter electrode 99 may be of any shape or size, here shown generally as a rod. A portion of the first counter electrode 99 may be insulated (not shown), but at least a portion is not covered with insulation and is immersed within the electrodeposition bath during the coating process.

The second counter electrode 120 may be of any shape or size, here shown generally as a rod, as long as its greatest length and/or width is less than the maximum width w1 of the internal opening 56 of the conductive substrate 50. A substantial portion of the second counter electrode 120 may be insulated with an insulator 122 to prevent incidental contact with the deployable primary electrode 140. At least a portion, here shown as the bottommost portion 124, of the second counter electrode 120 is not covered with insulation and is immersed within the electrodeposition bath 80 during the electrodeposition process (i.e. the bottommost portion 124 acts as the anode when the deployable primary electrode 140 is the cathode, and vice versa). In certain embodiments, the tip 124A of the bottommost portion 124, as shown in FIGS. 1-3, may also be insulated with the insulator 122.

The deployable primary electrode 140 includes a first electrode portion 141 comprising a first bar portion 142 extending from a first gear portion 143. The first bar portion 142 also includes a first contact portion 144 opposite the first gear portion 143. The first gear portion 143 is rotatably coupled to an insulator 161 and includes a plurality of teeth 145.

The deployable primary electrode 140 includes also includes a second electrode portion 151 comprising a second bar portion 152 extending from a second gear portion 153. The second bar portion 152 also includes a second contact portion 154 opposite the second gear portion 153. The second gear portion 153 is rotatably coupled to the insulator 161 and includes a plurality of teeth 155.

The deployable primary electrode 140 also includes a rod 160 having a first end 162 and a second end 164. The second end 164 includes a plurality of teeth 166 that separately engage the corresponding plurality of teeth 145 of the first internal electrode portion 141 and the plurality of teeth 155 of the second internal electrode portion 151. A portion 168 of the rod 160 may be encased within an insulating layer 170; however, the portion of the rod 160 that is contacting the first internal electrode portion 141 and second internal electrode portion 151 is exposed (i.e. not covered with an insulating layer 170). As shown in FIGS. 1-3, the rod 160 is coupled to a current source 190 at its first end 162, although the particular location of coupling may accomplished anywhere along the entirety of the deployable primary electrode 140 and is not limited by the configuration provided in FIGS. 1-3.

To utilize the geared insertion electrode assembly 100 to coat the conductive substrate 50, it must first be inserted within an internal opening 56 of a conductive substrate 50 in its non-deployed position, as shown in FIG. 1. This is done by moving geared insertion electrode assembly 100 through the internal opening 56 such that the entirety of the first internal electrode portion 151 and second internal electrode portion 141 and the bottommost portion 124 of the counter electrode 120 are contained within the hollowed out region 62 of the conductive substrate 50.

After insertion, the deployable primary electrode 140 is deployed (i.e. moved from its non-deployed position or insertion position, as shown in FIG. 1, through its partially-deployed position, as shown in FIG. 2, to its deployed position or operational position, as shown in FIG. 3). To accomplish this, the rod 160 is moved in a first direction (downward as shown by arrows 195 in FIG. 3). The meshed teeth 166 of the rod 160 moving in the first direction cause the corresponding meshed teeth 145 of the first gear portion 143 to rotate in a first direction (clockwise as shown by arrows 196 in FIG. 3) and meshed gear teeth 155 of the second gear portion 153 to rotate in second direction (counterclockwise as shown by arrows 192 in FIG. 3), with the first rotational direction being opposite the second rotational direction. This causes the first contact portion 144 and the second contact portion 154 to move outwardly away from each other to a deployed position, as shown in FIG. 3. The distance d1 between the first contact portion 144 and the second contact portion 154 in the deployed position is greater than the maximum width w1 of the internal opening 56 of the conductive substrate 50. The deployable primary electrode 140 is then positioned such that the first contact portion 144 and the second contact portion 154 contact a respective portion 55A, 55B of an inner surface 54 of the conductive substrate 50.

The conductive substrate 50, the counter electrode 99, and the geared insertion electrode assembly 100 may then be immersed in an electrodeposition bath 80 having an electrodepositable coating composition 82 at a predetermined bath temperature. Alternatively, as shown in FIGS. 1-3, the conductive substrate 50 may be immersed in the electrodeposition bath 80 prior to insertion and deployment of the geared insertion electrode assembly 100 and counter electrode 99. A direct current is then applied from the current source 190 to a predetermined voltage for a predetermined amount of time to apply a coating layer (not shown) to the inner surface 54 and outer surface 52 at a predetermined thickness in a conventional manner well known to those of ordinary skill in the art in the electrodeposition process.

To remove the geared insertion electrode assembly 100 after the electrodeposition process, the primary electrode 140 is moved such that the first contact portion 144 and the second contact portion 154 are no longer contact the respective portion 55A, 55B of the inner surface 54 of the conductive substrate 50 (i.e., the electrode assembly 100 is moved from its deployed position, as shown in FIG. 3, through its partially-deployed position, as shown in FIG. 2, to its non-deployed position, as shown in FIG. 1). Next, the rod 160 is moved in a second direction opposite the first direction (upward as shown in FIG. 3, opposite arrow 195)). The meshed teeth 166 of the rod 160 moving in the second direction cause the corresponding meshed teeth 144 of the first gear portion 143 to rotate in a second direction (counterclockwise as shown in FIG. 3, opposite of arrow 196) and meshed gear teeth 154 of the second gear portion 153 to rotate in first direction (clockwise as shown in FIG. 3, opposite arrow 192). This causes the first contact portion 144 and second contact portion 154 to move inwardly towards each other to a non-deployed position, as shown in FIG. 1. The distance d2 between the first contact portion 144 and the second contact portion 154 in the non-deployed position is less than the maximum width w1 of the internal opening so that the electrode assembly 100 can be easily removed through the internal opening 56. The electrode assembly 100 may then be removed from the hollowed out region 62 through the internal opening 56.

The coated substrate may then be rinsed and baked in an oven, by means well known to those of ordinary skill in the coatings art, to form a cured coating layer on the inner surface 54 and outer surface 52 of the conductive substrate 50. Alternatively, the coated substrate could be rinsed prior to removal of the geared insertion electrode assembly 100.

Figure 4:
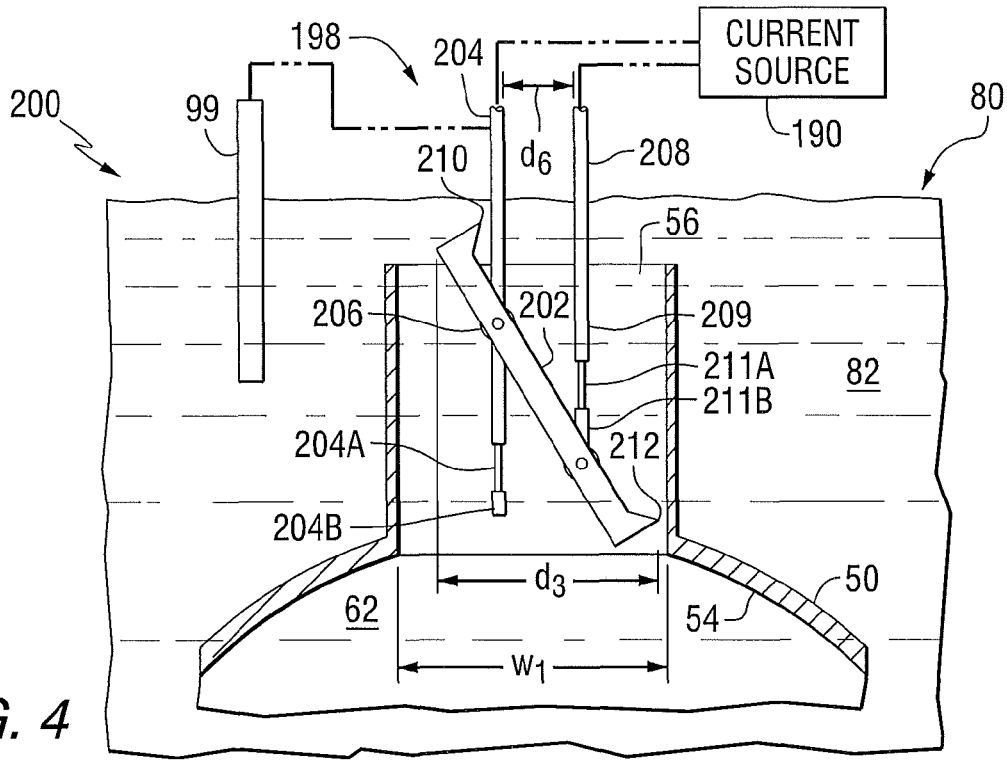
FIG. 4 is a view of an electrode assembly for an electrodeposition system having an electrode assembly in a non-deployed position prior to insertion within a conductive substrate according to another embodiment of the present invention.
Figure 5:
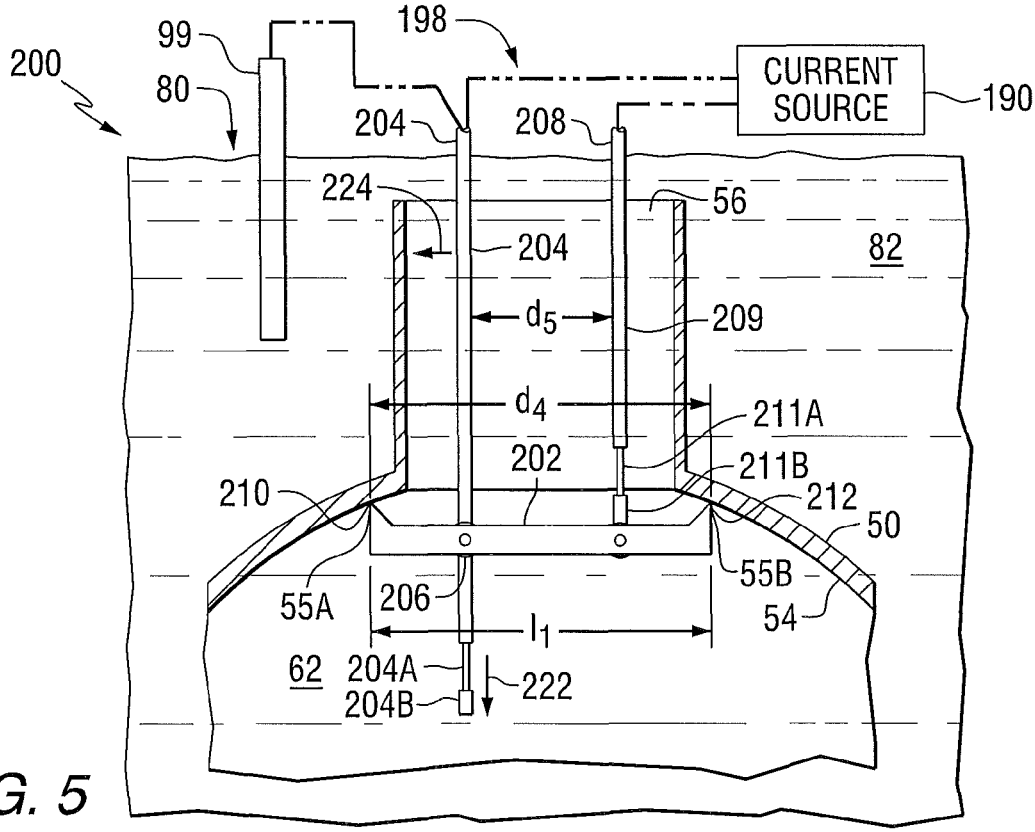
FIG. 5 is a view of an electrode assembly of FIG. 4 having an electrode assembly inserted within the conductive substrate and in a deployed position.

In another exemplary embodiment, as shown in FIGS. 4-5, the internal electrode assembly 198 comprises the first counter electrode 99 and a bar insertion electrode assembly 200 that includes a metal bar 202 pivotally coupled to an insulator 206, which itself is separately coupled to a second counter electrode 204. The metal bar 202 is also pivotally coupled to a primary electrode 208. The metal bar 202 has a first contact portion 210 and said second contact portion 212. In certain embodiments, the metal bar 202 may be insulated with an insulator 205 substantially along its length. At least a portion, here the bottom portion 204A, is not covered with insulation. In certain embodiments, the tip portion 204B is insulated with the insulator 205. Similarly, the primary electrode 208 may be insulated with an insulator 209 substantially along its length. At least a portion, here the bottom portion 211A, is not covered with insulation. In certain embodiments, the tip portion 211B is covered with the insulator 209. As in FIGS. 1-3, the primary electrode 208 and the second counter electrode 204 and/or the first counter electrode 99 are electrically coupled to the current source 190. As shown in FIGS. 4 and 5, the primary electrode 208 and the second counter electrode 204 are electrically coupled to the current source 190, while the first counter electrode 99 is electrically coupled to the second counter electrode 204.

Similar to the geared insertion electrode assembly 100 of FIGS. 1-3, the bar insertion electrode assembly 200 of FIGS. 4-5 is movable between a non-deployed position and a deployed position. In its non-deployed position, as shown in FIG. 4, the distance d3 between the first contact portion 210 and the second contact portion 212 is less than the maximum width w1 of the internal opening 56 of the conductive substrate 50. Conversely, in its deployed position, as shown in FIG. 5, the distance d4 between the first contact portion 210 and the second contact portion 212 is greater than the maximum width w1 of the internal opening 56 of the conductive substrate 50.

To utilize the bar insertion electrode assembly 200, it must first be inserted within an internal opening 56 of a conductive substrate 50 while the assembly 200 is in its non-deployed position, as shown in FIG. 4. This is done by moving the bar insertion electrode assembly 200 through the internal opening 56 and within the hollowed out interior region 62 of the conductive substrate 50.

After insertion, as shown in FIG. 5, the bar insertion electrode assembly 200 is moved from its non-deployed position to its deployed position by moving the counter electrode 204 in a first direction relative to the primary electrode 208 (downward as shown by arrows 222 in FIG. 5) and in a direction away from the primary electrode 208 (left as shown by arrows 224 in FIG. 5). The relative movement of said second counter electrode 204 downward and away from the primary electrode 208 causes the metal bar 202 to pivot relative to the counter electrode 204 and to the primary electrode 208. In the deployed position, the relative distance d5 between the primary electrode 208 and second counter electrode 204 is maximized, and corresponds to a position wherein the length l1 of the metal bar 212 is perpendicular to both the primary electrode 208 and counter electrode 204 (shown as horizontal in FIG. 5). The bar insertion electrode assembly 200 is then positioned wherein the first contact portion 210 and second contact portion 212 contact respective portions 55A, 55B of the inner surface 54 of the conductive substrate 50.

Of course, alternatively, as opposed to moving the second counter electrode 204 downward and away from the primary electrode 208 to pivot the metal bar 202, the same result can be achieved by moving the primary electrode 208 upward and away from the second counter electrode 204. Still further, the pivoting of the metal bar 202 to and from the horizontal position may also be achieved by moving both the primary electrode 208 and the second counter electrode 204 at the same time in opposite directions and away or towards one another and still fall within the spirit of the present invention. For ease of description and depiction, the movement of the counter electrode 204 is shown in FIG. 5.

The conductive substrate 50, the first counter electrode 99, and the bar insertion electrode assembly 200 may then be immersed in an electrodeposition bath 80 having an electrodepositable coating composition 82 at a predetermined bath temperature. A direct current is then applied from the current source 190 to a predetermined voltage for a predetermined amount of time to apply a coating layer (not shown) to the inner surface 54 and outer surface 52 at a predetermined thickness in a conventional manner well known to those of ordinary skill in the art in the electrodeposition process.

To remove the bar insertion electrode assembly 200, the first contact portion 210 and second contact portion 212 are first moved out of contact with respective portions 55A, 55B of the inner surface 54 of the conductive substrate 50. Next, the bar insertion electrode assembly 200 is moved from the deployed position to the non-deployed position by moving the second counter electrode 204 in a second direction opposite the first direction (upward as shown in FIG. 5—opposite arrow 222) and also in a direction towards the primary electrode 208 (right as shown in FIG. 5—opposite arrow 224). The relative movement of the second counter electrode 204 upward and towards the primary electrode 208 causes the metal bar 202 to pivot relative to the second counter electrode 204 and to the primary electrode 208 and into the non-deployed position. In the non-deployed position, the relative distance d6 between the primary electrode 208 and second counter electrode 204 is minimized, and corresponds to a position wherein the length l1 of the metal bar 212 is close to vertical with respect to both the primary electrode 208 and second counter electrode 204 (shown as substantially vertical in FIG. 4). The bar insertion electrode assembly 200 may then be removed from the internal region 62 through the opening 56 of the conductive substrate 50. Again, as above, the movement back to the non-deployed position may also be achieved by moving the primary electrode 208 (downward as shown in FIG. 5), or by moving both the second counter electrode 204 in the second direction (upward as shown in FIG. 5) and primary electrode 208 opposite the second direction (downward as shown in FIG. 5), and achieve the same result.

The coated substrate may then be rinsed and baked in an oven, by means well known to those of ordinary skill in the coatings art, to form a cured coating layer on the inner surface 54 and outer surface 52 of the conductive substrate 50. Alternatively, the coated substrate could be rinsed prior to removal of the electrode assembly 200.

Figure 6:
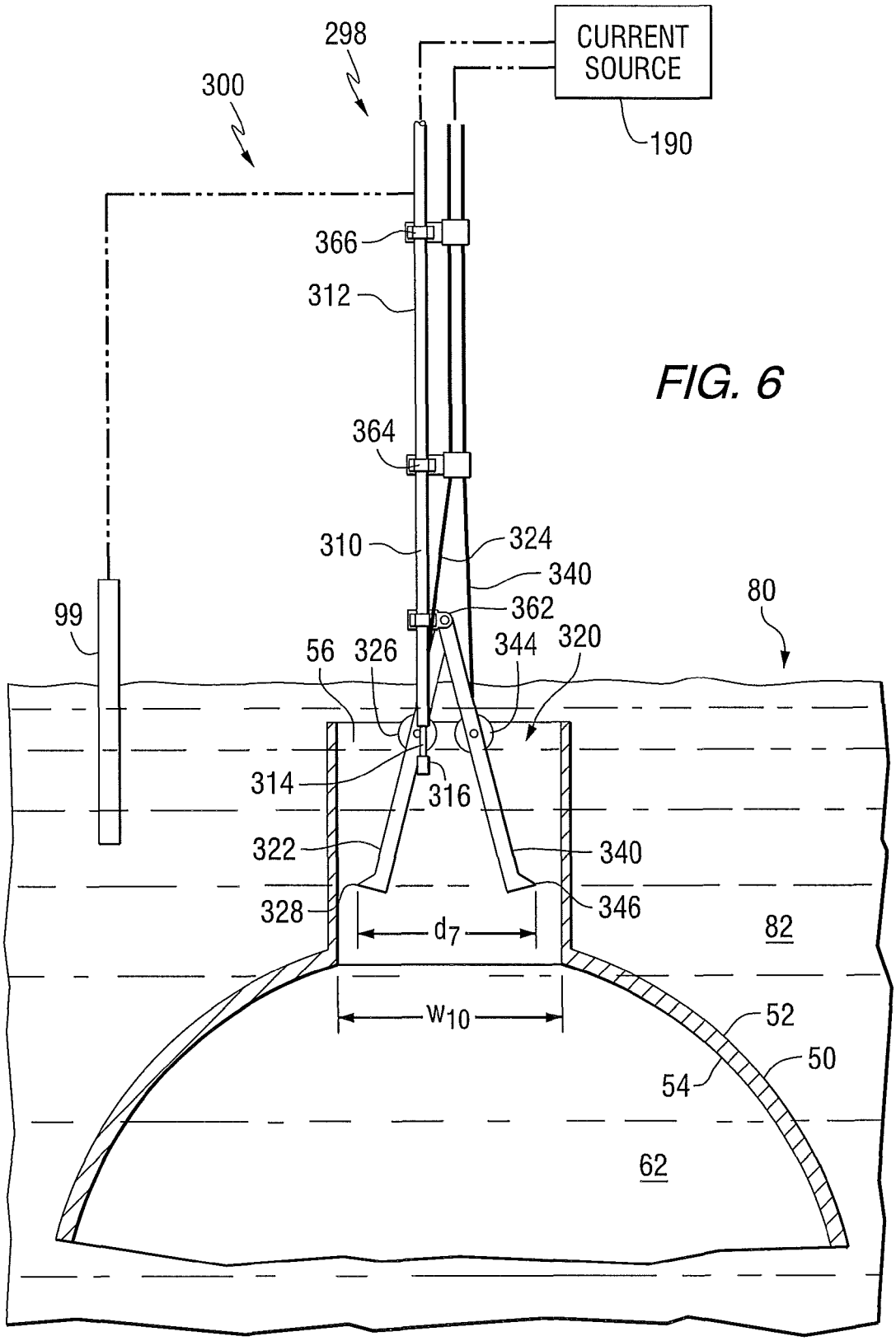
FIG. 6 is a view of an electrode assembly for an electrodeposition system having an electrode assembly in a non-deployed position prior to insertion within a conductive substrate according to yet another embodiment of the present invention.
Figure 7:
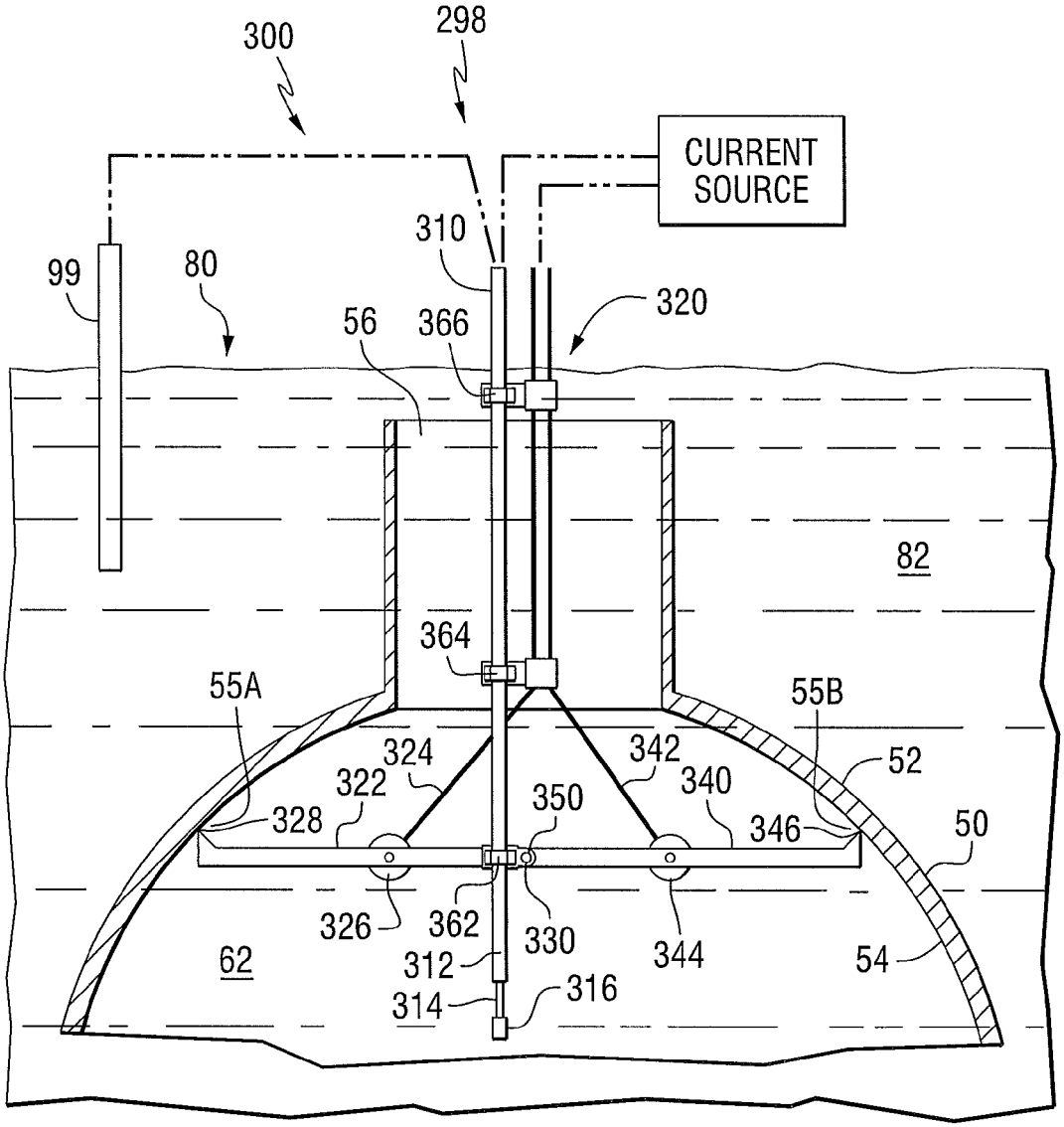
FIG. 7 is a view of an electrode assembly of FIG. 6 having an electrode assembly inserted within the conductive substrate and in a deployed position.

In still another exemplary embodiment, as shown in FIGS. 6-7, the electrode assembly 298 comprises a first counter electrode 99 and a toggle electrode assembly 300 having a second counter electrode 310 and a deployable primary electrode 320. As in FIGS. 1-3, the deployable primary electrode 320 and the second counter electrode 310 and/or the first counter electrode 99 are electrically coupled to the current source 190. As shown in FIGS. 6 and 7, the primary electrode 320 and the second counter electrode 310 are electrically coupled to the current source 190, while the first counter electrode 99 is electrically coupled to the second counter electrode 310.

The second counter electrode 310 may be of any shape or size, here shown generally as a rod, as long as its greatest length and/or width is less than the maximum width w10 of the internal opening 56 of the conductive substrate 50. A substantial portion of the second counter electrode 310 may be insulated with an insulator 312 to prevent incidental contact with the deployable primary electrode 320. At least a portion, here shown as the bottommost portion 314, of the second counter electrode 310 is not covered with insulation and is immersed within the electrodeposition bath 80 during the electrodeposition process (i.e. the bottommost portion 314 acts as the anode when the deployable primary electrode is the cathode, and vice versa). In certain embodiments, the tip portion 316 of the second counter electrode 310 is insulated with the insulator 312.

The deployable primary electrode 320 includes a first bar portion 322 coupled to a first wire 324 through a ring portion 326. The ring portion 326 is located between a first contact portion 328 and a pivot portion 330.

The deployable primary electrode 320 also has a second bar portion 340 coupled to a second wire 342 through a ring portion 344. The ring portion 344 is located between a second contact portion 346 and a pivot portion 350. The pivot portion 350 of the second bar portion 340 is also pivotally coupled to the pivot portion 330 of the first bar portion 322.

In addition, one or more insulators, here shown as two insulators 362, 364, are preferably used to support the first and second wires 324, 342 in close proximity to the second counter electrode 310. In addition, a third insulator portion 366 may be slidingly coupled to the second counter electrode 310 and first and second wires 324, 340 to maintain the positioning of the first and second wires 324, 340 relative to the second counter electrode 310.

To utilize the toggle-type electrode assembly 300, it must first be inserted within an internal opening 56 of a conductive substrate in its non-deployed position, as shown in FIG. 6. This is done by moving the electrode assembly 300 through the internal opening 56 and within the hollowed out interior 62 of the conductive substrate 50.

The non-deployed position, as shown best in FIG. 6, is characterized wherein the contact portions 328, 346 are pivoted into close proximity with one another. The distance d7 between the respective contact portions 328, 346, in this non-deployed position, is less than the width w1 of the internal opening 56, which allows the assembly 300 to be inserted within the interior 62 of the conductive substrate 50 through the internal opening 56.

After insertion, as shown in FIG. 7, the toggle-type electrode assembly 300 is moved from its non-deployed position to its deployed position by moving the first and second wires 324, 342 in a first direction (downward as shown in FIG. 7). The movement of the first wire 324 and the second wire 342 in a first direction allows the first contact portion 328 of the first bar portion 322 and the second contact portion 346 of the second bar portion 340 to pivot away from each other. The pivoted first and second contact portions 328, 346 are then brought into contact with respective portions 55A, 55B of the inner surface 54 of the conductive substrate 50.

The conductive substrate 50, first counter electrode 99 and the toggle type electrode assembly 300 may then be immersed in an electrodeposition bath 80 having an electrodepositable coating composition 82 at a predetermined bath temperature. A direct current is then applied from the current source 190 to a predetermined voltage for a predetermined amount of time to apply a coating layer (not shown) to the inner surface 54 and outer surface 52 at a predetermined thickness in a conventional manner well known to those of ordinary skill in the art in the electrodeposition process.

To remove the toggle-type electrode assembly 300, the assembly is first moved from its deployed position to its non-deployed position by moving the first and second wires 324, 342 in a second direction opposite the first direction (upward as shown in FIG. 7). The movement of the first wire 324 and the second wire 342 in the second direction pulls the pivot portions 330, 350 towards the insulator portion 364. This movement causes the first contact portion 328 of the first bar portion 322 and the second contact portion 346 of the second bar portion 340 to pivot towards each other and back to its non-deployed position, as shown best in FIG. 6. The toggle-type electrode assembly 300 may then be removed from the interior 62 of the conductive substrate 50 through the internal opening 56 by moving the electrode assembly 300 in a second direction (upward as shown in FIG. 6).

Figure 8:
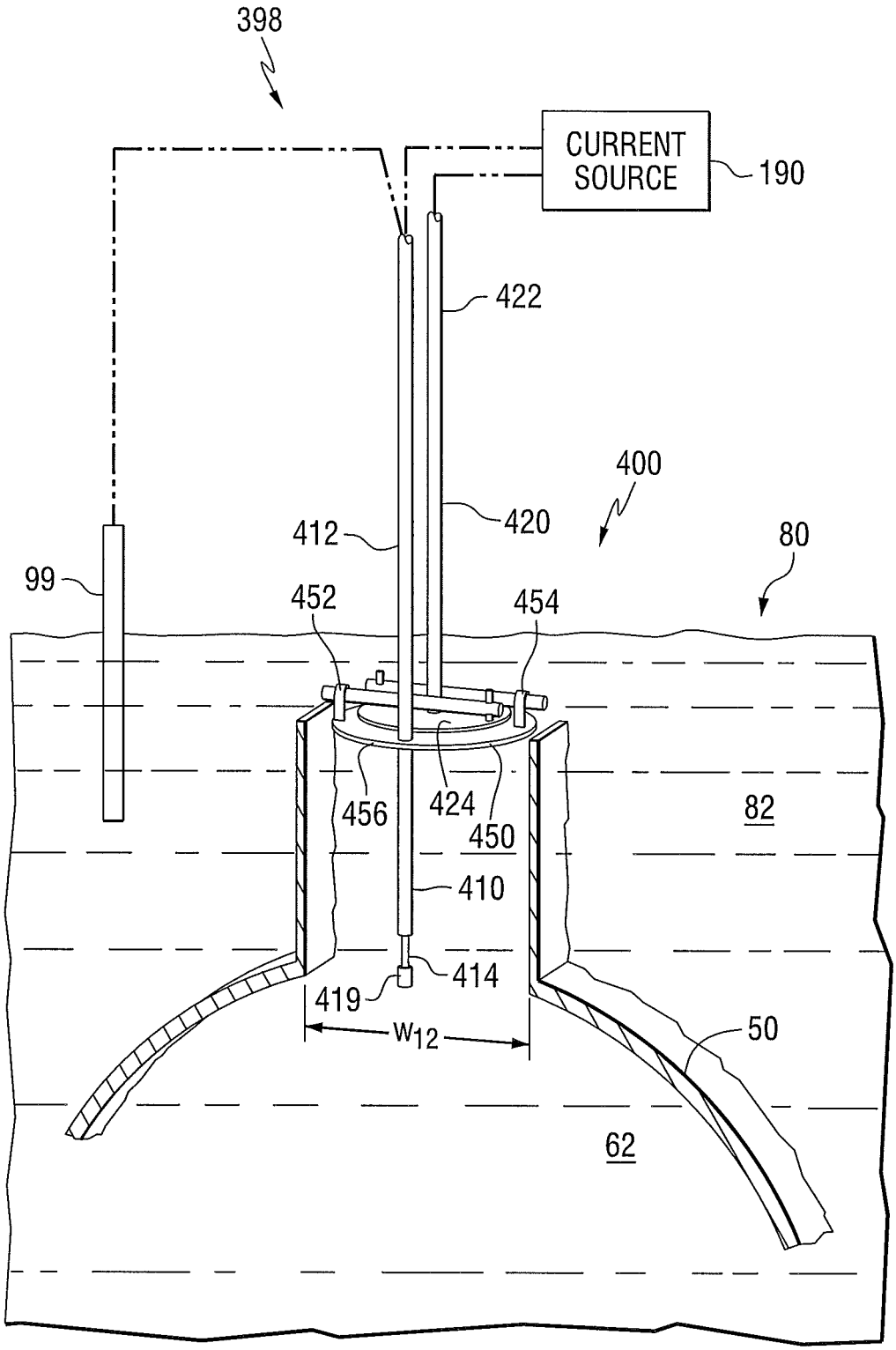
FIG. 8 is a perspective view of an electrode assembly for an electrodeposition system having an electrode assembly in a non-deployed position prior to insertion within a conductive substrate according to still another embodiment of the present invention.
Figure 9:
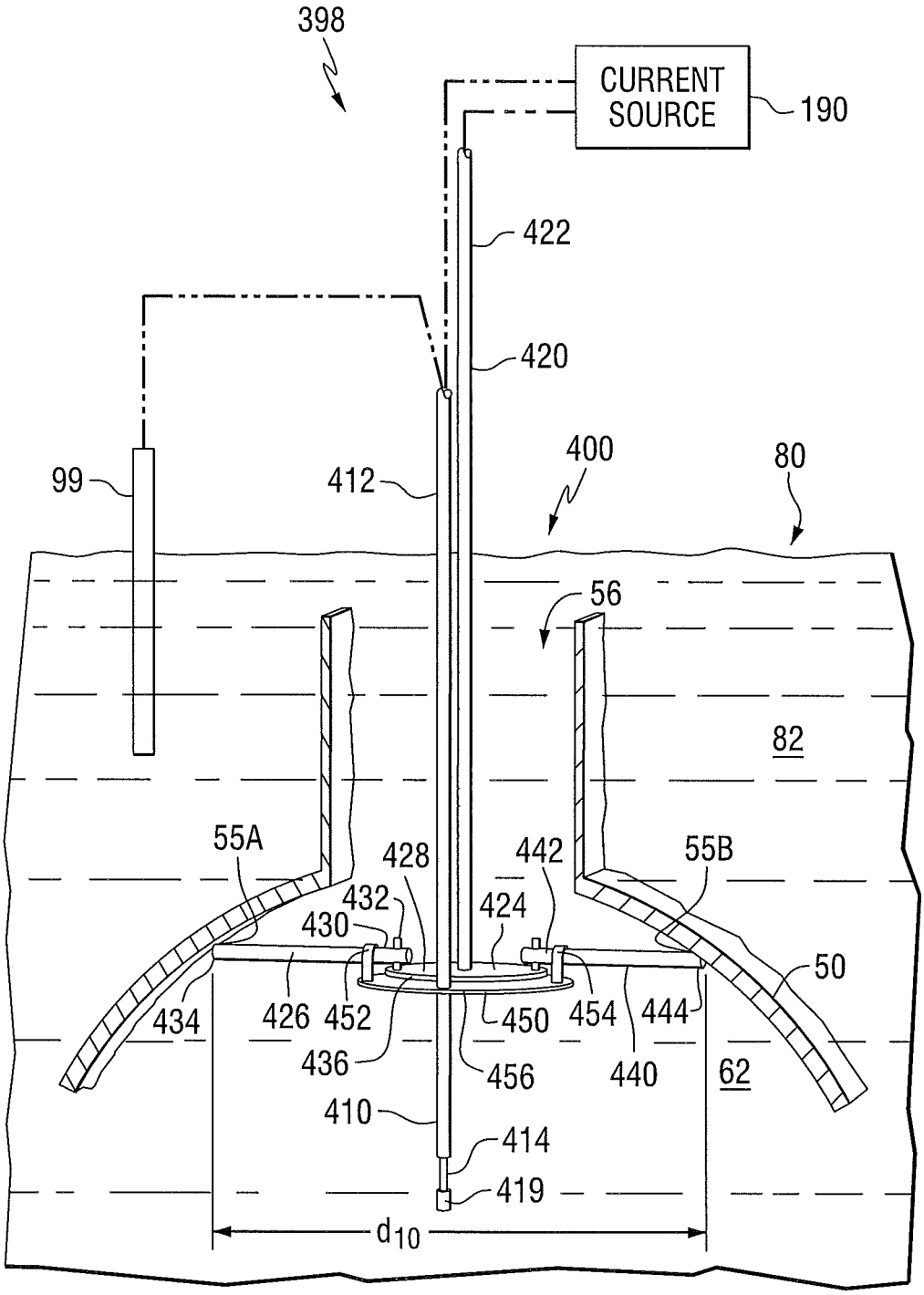
FIG. 9 is a perspective view of an electrode assembly of FIG. 8 having an electrode assembly inserted within the conductive substrate and in a deployed position.

In still another embodiment, as shown in FIG. 8-9, the electrode assembly 398 comprises a first counter electrode 99 and a torsional insertion electrode assembly 400 that includes a second counter electrode 410 and a deployable primary electrode 420. As in FIGS. 1-3, the deployable primary electrode 420 and the second counter electrode 410 and/or the first counter electrode 99 are electrically coupled to the current source 190. As shown in FIGS. 8 and 9, the primary electrode 420 and the second counter electrode 410 are electrically coupled to the current source 190, while the first counter electrode 99 is electrically coupled to the second counter electrode 420.

The second counter electrode 410 may be of any shape or size, here shown generally as a rod, as long as its greatest length and/or width is less than the maximum width w12 of the internal opening 56 of the conductive substrate 50. A substantial portion of the second counter electrode 410 may be insulated with an insulator 412 to prevent incidental contact with the deployable primary electrode 420. At least a portion, here shown as the bottommost portion 414, of the second counter electrode 410 is not covered with insulation and is immersed within the electrodeposition bath 80 during the electrodeposition process (i.e. the bottommost portion 414 acts as the anode when the deployable primary electrode is the cathode, and vice versa). In certain embodiments, the tip portion 419 of the second counter electrode 410 is insulated with the insulator 412.

The primary electrode 420 includes having a length portion 422, here depicted as a rod, coupled to a disk portion 424. A first bar portion 426 is fixedly coupled to a first surface 428 of the disk portion 424 at a first end 430 using a pin 432. The first bar portion 426 also has a first contact portion 434 opposite the first end 430.

In addition, the primary electrode 420 has a second bar portion 440 that is also fixedly coupled to the first surface 428 of the disk portion 424 at a second end 442. The second bar portion 440 also has a second contact portion 444 opposite said second end 442.

The primary electrode 420 also has an insulating disk portion 450 coupled to the outer periphery 436 of the disk portion 424 and is fixedly coupled to the counter electrode 410. The insulating disk portion 450 is rotatable around the inner disk portion 424. The insulating disk portion 450 also includes a first stopper portion 452 associated with the first contact portion 434 and a second stopper portion 454 associated with the second contact portion 444.

To utilize the torsional insertion electrode assembly 400, it must first be inserted within an internal opening 56 of a conductive substrate 50 in its non-deployed position, as shown in FIG. 8. This is done by moving the assembly 400 through the internal opening 56 and within the hollowed out interior 62 of the conductive substrate 50.

The non-deployed position, as shown best in FIG. 8, is characterized wherein each of the bar portions 426, 440 are positioned substantially adjacent to one another along their length and wherein the substantial entirety of their respective lengths are adjacent to the first surface 428 of the disk portion 424. In addition, the first contact portion 434 is adjacent to the first stopper portion 452 and the second contact portion 444 is adjacent to the second stopper portion 454.

Once inserted within the interior 62 of the conductive substrate 50, as best shown in FIG. 9, the primary electrode 420 is moved from its non-deployed position to its deployed position by rotating the disk portion 424 in a first direction (clockwise as shown in FIG. 9) relative to the stationary insulating disk portion 450. The rotation disk portion 424 causes said first contact portion 434 and the second contact portion 444 first move out of contact with their respective stopper portions 452 and 454. After approximately 180 degrees of rotation, the first bar portion 426 is brought back into a position adjacent the first stopper portion 452, but wherein the first contact portion 434 is not adjacent the first stopper portion 452 and is instead extended outwardly away from the outer periphery 456 of the insulating disk portion 450. Similarly, at 180 degrees of rotation, the second bar portion 440 is brought back into a position adjacent the second stopper portion 454, but wherein the second contact portion 444 is not adjacent the second stopper portion 454 and is instead extended outwardly away from the outer periphery 456 of the insulating disk portion 450. In the deployed position, the distance d10 between the first contact portion 434 and the second contact portion 444 is at its maximum and is greater than the maximum width w12 of the internal opening 56. The first contact portion 434 and the second contact portion 444 are then placed into contact with the respective inner portions 55A, 55B of the inner surface.

The conductive substrate 50, first counter electrode 99 and the torsional insertion electrode assembly 400 may then be immersed in an electrodeposition bath 80 having an electrodepositable coating composition 82 at a predetermined bath temperature. A direct current is then applied from the current source 190 to a predetermined voltage for a predetermined amount of time to apply a coating layer (not shown) to the inner surface 54 and outer surface 52 at a predetermined thickness in a conventional manner well known to those of ordinary skill in the art in the electrodeposition process.

To remove the torsional insertion electrode assembly 400 after electrocoating, the primary electrode 420 is moved back from its deployed position to its non-deployed position. This is done by rotating the disk portion 424 in a second direction (counterclockwise as shown in FIG. 9) 180 degrees relative to the stationary insulating disk portion 450, wherein the second direction is opposite the first direction. This brings the first contact portion 434 back into position adjacent the first stopper portion 452 and the second contact portion 444 back into position adjacent the second stopper portion 454. The torsional insertion electrode assembly 400 may then be removed from the interior 62 of the conductive substrate 50 through the internal opening 56 by moving the electrode assembly 400 in a second direction (upward as shown in FIGS. 8 and 9).

While each of the exemplary embodiments shows the insertion of a single electrode assembly within a single conductive substrate, it is specifically contemplated that this system can be scaled up to coat multiple conductive substrates, such as multiple hand grenades in a single application step that utilizes one deployable electrode assembly per hand grenade. Further, the exemplary embodiments may be modified as to size and shape to be utilized with various other conductive parts having different part geometries, and thus are not limited to the part geometries described herein. For example, the inner surface may have a different relative shape compared to the outer surface, or the inner surface and outer surface may have a different overall shape other than substantially spherical, as in the case of a hand grenade. Moreover, it is specifically contemplated wherein the second counter electrode, the first counter electrode and the primary electrode themselves may have different shapes, with the caveat that the electrode assembly can easily be inserted within the hollowed out interior region of the conductive substrate in a non-deployed position and thereafter be placed into contact with the inner surface of the conductive substrate in the deployed position. Again, as noted above, it is also contemplated that the primary electrode may act as the anode and the counter electrodes act as cathodes in certain systems, or the primary electrode may act as the cathode and the counter electrodes may act as the anodes in certain systems, with substantially the same configuration of assembly parts. Further, in other exemplary embodiments, multiple first counter electrodes may be utilized in conjunction with a single deployable internal electrode assembly to coat individual conductive substrates. Also, in still other exemplary embodiments not shown, multiple deployable electrode assemblies may be inserted into a single hollow interior region of a conductive substrate. In still other exemplary embodiments, the number of second counter electrodes may be different in number from the number of primary electrodes and still fall within the spirit of the present invention. In any of the exemplary embodiments illustrated or contemplated, the coatings coverage on the entirety of the surfaces of the conductive substrate, whether external or internal, can be greatly enhanced.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electrode assembly comprising:

(a) a current source;

(b) a first counter electrode; and (c) an internal electrode assembly comprising:

(1) a second counter electrode; and (2) a deployable primary electrode insulatingly coupled to said second counter electrode, wherein said deployable primary electrode is movable between a non-deployed position and a deployed position, said deployable primary electrode comprising a first contact portion and a second contact portion;

wherein said first contact portion and said second contact portion are separated by a first distance in said non-deployed position and wherein said first contact portion and said second contact portion are separated by a second distance in said deployed position, said first distance is different than said second distance.

2. The electrode assembly of claim 1, wherein said deployable primary electrode is electrically coupled to said current source; and wherein at least one of said first counter electrode and said second counter electrode are electrically coupled to said current source.

3. The electrode assembly of claim 2, wherein said second counter electrode is electrically coupled to said first counter electrode.

4. The electrode assembly of claim 1, wherein said deployable primary electrode comprises:

a rod having a first end and a second end, said second end having a plurality of external teeth, said first rod moveable in a first direction and a second direction parallel to the length of said bar, said second direction being opposite said first direction;

a first electrode portion comprising a first bar portion extending from a first gear portion, said first bar portion including said first contact portion opposite said first gear portion, said first gear portion rotatably coupled to said insulator, said first gear portion including a plurality of teeth engaged with said plurality of said corresponding external teeth of said rod; and a second electrode portion comprising a second bar portion extending from a second gear portion, said second bar portion including said second contact portion opposite said second gear portion, said second gear portion rotatably coupled to said insulator, said second gear portion including a plurality of teeth engaged with said plurality of corresponding external teeth on said rod;

wherein the movement of said rod in a first direction causes said first contact portion and said second contact portion move from said first position to said second position, and wherein the movement of said rod in a second direction causes said first contact portion and said second contact portion to move from said second position to said first position.

5. The electrode assembly of claim 1, wherein said deployable primary electrode comprises:

a rod having a first end and a second end, said rod moveable in a first direction and a second direction parallel to the length of said rod, said second direction being opposite said first direction; and a metal bar pivotally coupled to said rod and insulatingly and pivotally coupled to said second counter electrode, said metal bar having said first contact portion and said second contact portion;

wherein the movement of said rod in a first direction causes said first contact portion and said second contact portion of said metal bar to move from said first position to said second position, and wherein the movement of said rod in a second direction causes said first contact portion and said second contact portion of said metal bar to move from said second position to said first position.

6. The electrode assembly of claim 1, wherein said deployable primary electrode comprises:

a first wire insulatingly coupled to said second counter electrode, said first wire moveable in a first direction and a second direction parallel to the length of said first wire, said second direction being opposite said first direction;

a second wire insulatingly coupled to said second counter electrode, said second wire moveable in a first direction and a second direction parallel to the length of said first wire, said second direction being opposite said first direction;

a first bar portion coupled to said first wire, said first bar portion comprising a ring portion located between said first contact portion and a pivot portion; and a second bar portion coupled to said second wire, said second bar portion comprising a ring portion located between said second contact portion and a pivot portion, said pivot portion of said second bar portion being pivotally coupled to said pivot portion of said first bar portion;

wherein said pivot portion of said first bar portion and said pivot portion of said second bar portion are insulatingly coupled to said second counter electrode;

wherein the movement of said first wire in said first direction and said second wire in said first direction causes said first contact portion and said second contact portion to move from said first position to said second position, and wherein the movement of said first wire in said second direction and said second wire in said second direction causes said first contact portion and said second contact portion to move from said second position to said first position.

7. The electrode assembly of claim 1, wherein said deployable primary electrode comprises:

a bar portion coupled to a disk portion, said bar portion and said disk portion rotatable in a first direction and in a second direction, said first direction being opposite said second direction;

a first bar portion fixedly coupled to said disk portion at a first end, wherein said first bar portion has said first contact portion opposite said first end;

a second bar portion fixedly coupled to said disk portion at a second end, wherein said second bar portion has said second contact portion opposite said second end; and an insulating disk portion slidingly coupled around said disk portion and coupled to said second counter electrode, wherein the rotation of said bar portion and said disk portion in said first direction causes said first contact portion and said second contact portion to move from said first position to said second position, and wherein the rotation of said bar portion and said disk portion in said second direction causes said first contact portion and said second contact portion to move from said second position to said first position.

8. The electrode assembly of claim 7, wherein said insulating disk portion further comprises a first stopper portion and a second stopper.

9. A method for applying a coating composition to a conductive substrate having an outer surface and an inner surface, said inner surface defining a hollow interior region therewithin, the method comprising:

(a) coupling a first counter electrode to an electrode assembly to form an internal electrode assembly, said internal electrode assembly comprising:

(i) a second counter electrode; and (ii) a deployable primary electrode movable between a non-deployed position and a deployed position, wherein said deployable primary electrode comprises a first contact portion and a second contact portion, wherein said deployable primary electrode is in said non-deployed position;

(b) inserting said internal electrode assembly through an opening of the conductive substrate to the hollow interior region (c) moving said deployable primary electrode from said non-deployed position to said deployed position;

(d) contacting said first contact portion and said second contact portion with the inner surface of the conductive substrate;

(e) electrically coupling said deployable primary electrode and at least one of said second counter electrode and said first counter electrode to a current source;

(f) immersing said conductive substrate and said electrode assembly in a bath comprising the coating composition; and (g) electrophoretically depositing a coating layer of said coating composition onto the inner surface and onto the outer surface of the conductive substrate.

10. The method of claim 9, wherein a distance between said first contact portion and said second contact portion in said deployed position is greater than a maximum width of the opening of the conductive substrate; and wherein said distance between said first contact portion and said second contact portion in said non-deployed position is less than said maximum width; said distance being measured in a direction perpendicular to a length of said electrode assembly and in a direction parallel to said maximum width.

11. The method of claim 9 further comprising:

(h) moving said deployable primary electrode from said deployed position to said non-deployed position such that said first contact portion and said second contact portion are not in contact with the inner surface of the conductive substrate; and then (i) removing said electrode assembly from the hollow interior region and through said opening of the conductive substrate.

12. The method of claim 11 further comprising:

(j) curing said coating layer to form a cured coating layer on said external surface and on said internal surface after steps (g) and (h).

13. The method of claim 10 further comprising:

(h) rinsing said coating layer with water;

(i) moving said deployable primary electrode from said deployed position to said non-deployed position such that said first contact portion and said second contact portion are not in contact with the inner surface of the conductive substrate;

(j) removing said electrode assembly from the hollow interior region and through said opening of the conductive substrate; and (k) curing said coating layer to form a cured coating layer on the inner surface and the outer surface after steps (h), (i), and (j).

14. The method of claim 9, wherein said deployable primary electrode comprises:

a rod having a first end and a second end, said second end having a plurality of external teeth, said first rod moveable in a first direction and a second direction parallel to the length of said bar, said second direction being opposite said first direction;

a first electrode portion comprising a first bar portion extending from a first gear portion, said first bar portion including said first contact portion opposite said first gear portion, said first gear portion rotatably coupled to said insulator, said first gear portion including a plurality of teeth engaged with said plurality of said corresponding external teeth of said rod; and a second electrode portion comprising a second bar portion extending from a second gear portion, said second bar portion including said second contact portion opposite said second gear portion, said second gear portion rotatably coupled to said insulator, said second gear portion including a plurality of teeth engaged with said plurality of corresponding external teeth on said rod;

wherein the movement of said rod in a first direction causes said first contact portion and said second contact portion move from said first position to said second position, and wherein the movement of said rod in a second direction causes said first contact portion and said second contact portion to move from said second position to said first position.

15. The method of claim 9, wherein said deployable primary electrode comprises:

a rod having a first end and a second end, said first rod moveable in a first direction and a second direction parallel to the length of said bar, said second direction being opposite said first direction;

a metal bar pivotally coupled to said rod and insulatingly and pivotally coupled to said second counter electrode, said metal bar having said first contact portion and said second contact portion;

wherein the movement of said rod in a first direction causes said first contact portion and said second contact portion of said metal bar to move from said first position to said second position, and wherein the movement of said rod in a second direction causes said first contact portion and said second contact portion of said metal bar to move from said second position to said first position.

16. The method of claim 9, wherein said deployable primary electrode comprises:

a first wire insulatingly coupled to said second counter electrode, said first wire moveable in a first direction and a second direction parallel to the length of said first wire, said second direction being opposite said first direction;

a second wire insulatingly coupled to said second counter electrode, said second wire moveable in a first direction and a second direction parallel to the length of said first wire, said second direction being opposite said first direction;

a first bar portion coupled to said first wire, said first bar portion comprising a ring portion located between said first contact portion and a pivot portion; and a second bar portion coupled to said second wire, said second bar portion comprising a ring portion located between said second contact portion and a pivot portion, said pivot portion of said second bar portion being pivotally coupled to said pivot portion of said first bar portion;

wherein said pivot portion of said first bar portion and said pivot portion of said second bar portion are insulatingly coupled to said primary electrode;

wherein the movement of said first wire in said first direction and said second wire in said first direction causes said first contact portion and said second contact portion to move from said first position to said second position, and wherein the movement of said first wire in said second direction and said second wire in said second direction causes said first contact portion and said second contact portion to move from said second position to said first position.

17. The method of claim 9, wherein said deployable primary electrode comprises:

a bar portion coupled to a disk portion, said bar portion and said disk portion rotatable in a first direction and in a second direction, said first direction being opposite said second direction;

a first bar portion fixedly coupled to said disk portion at a first end, wherein said first bar portion has said first contact portion opposite said first end;

a second bar portion fixedly coupled to said disk portion at a second end, wherein said second bar portion has said second contact portion opposite said second end; and an insulating disk portion slidingly coupled around said disk portion and coupled to said second counter electrode, wherein the rotation of said bar portion and said disk portion in said first direction causes said first contact portion and said second contact portion to move from said first position to said second position, and wherein the rotation of said bar portion and said disk portion in said second direction causes said first contact portion and said second contact portion to move from said second position to said first position.

18. The method of claim 9, wherein said deployable internal primary electrode comprises:

a bar portion coupled to a disk portion, said bar portion and said disk portion rotatable in a first direction and in a second direction, said first direction being opposite said second direction;

a first bar portion fixedly coupled to said disk portion at a first end, wherein said first bar portion has said first contact portion opposite said first end;

a second bar portion fixedly coupled to said disk portion at a second end, wherein said second bar portion has said second contact portion opposite said second end; and an insulating disk portion slidingly coupled around said disk portion and coupled to said second counter electrode, wherein said insulating disk portion comprises a first stopper portion and a second stopper portion, wherein the rotation of said bar portion and said disk portion in said first direction causes said first contact portion and said second contact portion to move from said first position to said second position, and wherein the rotation of said bar portion and said disk portion in said second direction causes said first contact portion and said second contact portion to move from said second position to said first position, wherein said first contact portion is coupled to said first stopper portion and wherein said second contact portion is coupled to said second stopper portion in said first position and wherein said first contact portion is not coupled to said first stopper portion and wherein said second contact portion is not coupled to said second stopper portion in said second position.

19. The method of claim 9, wherein (e) electrically coupling said deployable primary electrode and at least one of said second counter electrode and said first counter electrode to a current source comprises:

electrically coupling said deployable primary electrode and one of said second counter electrode or said first counter electrode to a current source; and electrically coupling said second counter electrode to said first counter electrode.

20. The method of claim 9, wherein (e) electrically coupling said deployable primary electrode and at least one of said second counter electrode and said first counter electrode to a current source comprises:

electrically coupling said deployable primary electrode, said second counter electrode; and said first counter electrode to a current source.

* * * * *